US011807496B2

(12) United States Patent
Steiner et al.

(10) Patent No.: US 11,807,496 B2
(45) Date of Patent: Nov. 7, 2023

(54) CATCHING DEVICE FOR A TRAVELING BODY, ELEVATOR SYSTEM HAVING A CATCHING DEVICE AND METHOD FOR UNBLOCKING A CATCHING DEVICE

(71) Applicant: Inventio AG, Hergiswil (CH)

(72) Inventors: Adrian Steiner, Inwil (CH); Christoph Schuler, Rotkreuz (CH); Daniel Meierhans, Sins (CH); Julian Stähli, Meggen (CH); Philipp Müller, Sempach (CH)

(73) Assignee: INVENTIO AG, Hergiswil (CH)

( * ) Notice: Subject to any disclaimer, the term of this patent is extended or adjusted under 35 U.S.C. 154(b) by 174 days.

(21) Appl. No.: 16/765,193

(22) PCT Filed: Dec. 6, 2018

(86) PCT No.: PCT/EP2018/083820
§ 371 (c)(1),
(2) Date: May 19, 2020

(87) PCT Pub. No.: WO2019/110740
PCT Pub. Date: Jun. 13, 2019

(65) Prior Publication Data

US 2020/0325001 A1 Oct. 15, 2020

(30) Foreign Application Priority Data

Dec. 7, 2017 (EP) ..... 17205780

(51) Int. Cl.
*B66B 5/22* (2006.01)
*B66B 5/16* (2006.01)

(52) U.S. Cl.
CPC . *B66B 5/22* (2013.01); *B66B 5/16* (2013.01)

(58) Field of Classification Search
CPC ..... B66B 5/22; B66B 5/16; B66B 5/18
See application file for complete search history.

(56) References Cited

U.S. PATENT DOCUMENTS 6,758,310 B2 7/2004 Muff et al.
6,997,287 B2 * 2/2006 Sasaki ..... B66B 5/22 188/189

(Continued)

FOREIGN PATENT DOCUMENTS

CN 101200259 A 6/2008
CN 101428722 A 5/2009

(Continued)

OTHER PUBLICATIONS

Machine translation of WO 2014033846 A1, Mar. 6, 2014 (Year: 2014).*

*Primary Examiner* — Michael R Mansen
*Assistant Examiner* — Michelle M Lantrip
(74) *Attorney, Agent, or Firm* — William J. Clemens; Shumaker, Loop & Kendrick, LLP

(57) ABSTRACT

A catching device for a traveling body in an elevator system and a method for unblocking the catching device include at least two retaining units that can be brought into a blocked state and into an unblocked state, the retaining units retaining the traveling body on a rail in the blocked state. The retaining units are connected to the traveling body such that each of the retaining units and the traveling body can be slid relative to each other within a limited sliding displacement. A first sliding displacement of a first of the retaining units is longer than a second sliding displacement of a second of the retaining units.

16 Claims, 5 Drawing Sheets

(56) References Cited

U.S. PATENT DOCUMENTS

| | | | | |
|---|---|---|---|---|
| 8,668,055 | B2 | 3/2014 | Spirgi | |
| 9,206,015 | B2 | 12/2015 | Osmanbasic et al. | |
| 9,309,091 | B2 | 4/2016 | Husmann | |
| 2008/0128218 | A1 | 6/2008 | Gremaud et al. | |
| 2015/0298937 | A1* | 10/2015 | Rieser | B66B 5/18 187/359 |
| 2019/0144240 | A1* | 5/2019 | Steinhauer | B66B 5/22 187/376 |
| 2021/0130129 | A1* | 5/2021 | Kennedy | B66B 15/00 |

FOREIGN PATENT DOCUMENTS

| | | | | | |
|---|---|---|---|---|---|
| CN | 103261073 | A | | 8/2013 | |
| CN | 103303763 | A | | 9/2013 | |
| CN | 103958385 | A | | 7/2014 | |
| CN | 104364179 | A | * | 2/2015 | B66B 5/22 |
| CN | 104583111 | A | | 4/2015 | |
| CN | 105377738 | A | | 3/2016 | |
| CN | 106494962 | A | | 3/2017 | |
| EP | 1213247 | A1 | | 6/2002 | |
| EP | 2352689 | B1 | | 8/2011 | |
| EP | 2785626 | B1 | | 10/2014 | |
| EP | 3141512 | A1 | | 3/2017 | |
| JP | 2011102165 | A | * | 5/2011 | B66B 5/04 |
| WO | WO-2012137248 | A1 | * | 10/2012 | B66B 5/04 |
| WO | WO-2013070234 | A1 | * | 5/2013 | B66B 5/18 |
| WO | 2014033846 | A1 | | 6/2014 | |

* cited by examiner

CATCHING DEVICE FOR A TRAVELING BODY, ELEVATOR SYSTEM HAVING A CATCHING DEVICE AND METHOD FOR UNBLOCKING A CATCHING DEVICE

FIELD

The invention relates to a catching device for a traveling body in an elevator system, to an elevator system having a catching device and to a method for unblocking a catching device.

BACKGROUND

Catching devices are used to brake a traveling body with respect to the elevator shaft. Catching devices in elevator systems are used with a variety of different operating principles. A catching device typically has at least one retaining means which can be brought into a blocked and an unblocked state and which, in the blocked state, retains the traveling body on a rail. The traveling body may be a load suspension device comprising an elevator car and possibly a car frame, or a counterweight for an elevator system.

The majority of catching devices have a clamping mechanism which, when actuated, for example by a speed limiter system, generates a clamping action between components of the catching device and at least one fixed rail mounted parallel to the travel path of the traveling body, using the kinetic energy of the traveling body. As a result of self-locking in the clamping mechanism, some of these catching devices can only be unblocked again with considerable force after the catching process.

In order to unblock catching devices having a self-locking clamping mechanism after a catching process, they must be moved against the direction of movement before the catching process, which is usually done by moving the traveling body. Such a movement is usually produced by lifting the traveling body with the drive unit of the elevator system or by lowering the traveling body with the drive unit using the weight of the traveling body, optionally a counterweight and possibly an additional load.

In order to overcome the self-locking effect of the clamping mechanism mentioned above, a significantly increased displacement force is required compared to normal operation, since the clamping forces and/or static friction must be overcome.

In some cases, the displacement force after a blocking of the catching device exceeds the available force of the drive unit or the weight force of the traveling body. Unblocking by manipulation on the catching device is usually not possible, because the catching device is not accessible in the case of a catching process.

From the printed publication EP 1 213 247 A1 a catching device is known which has a retaining means which is movable relative to the traveling body within a sliding displacement. After blocking the retaining means, the traveling body can be moved within a certain range, namely over the length of the sliding displacement, without unblocking the retaining means. The inertial force or kinetic energy resulting from the acceleration over the sliding displacement can be used to unblock the retaining means.

Since an elevator system is usually equipped with several retaining means, the additional kinetic energy applied may be too low to release all the retaining means.

The printed publication EP 2 352 689 B1 discloses a method for releasing a catching device for a traveling body from a catching position in a downward direction, in which a counterweight connected to the traveling body is first lifted and brought to a level of higher potential energy. If the counterweight is then moved back, this produces additional kinetic energy which helps to unblock the catching device. This method can only be used to unblock from a catching position in the downward direction; moreover, even in this case, the kinetic energy may be too low to release all the retaining means which are blocked during a catching process.

The printed publication EP 2 785 626 B1 shows a method for resetting a safety brake with electromechanical retaining means, in which the retaining direction is first brought into a defined braking position before the retaining means is released by moving in the opposite direction. When releasing the retaining means, the same problems occur as with purely mechanical brakes; the clamping force and/or static friction must also be overcome.

SUMMARY

An object underlying the present invention is to provide a catching device, an elevator system and a method for unblocking a catching device which overcomes the disadvantages of the prior art and which, in particular, enables such catching devices to be unblocked with reduced release force, i.e. by using the non-amplified drive unit of the elevator system or the weight force of the traveling body.

The object is achieved by a catching device for a traveling body with at least two retaining means. The holding devices can be brought into a blocked and an unblocked state. They can be mounted on a traveling body or are mounted on a traveling body in such a manner that they retain the traveling body on a rail in the locked state.

At least one retaining means can be connected or is connected to the traveling body in such a manner that the retaining means and traveling body can be displaced relative to each other within a limited sliding displacement.

A first sliding displacement of a first retaining means is longer than a second displacement of a second retaining means. The shorter sliding displacement has a length of 0 mm in borderline cases. This means that the shorter sliding displacement can be infinitesimally short.

If, after a catching process, the traveling body is set in motion in a direction in which the retaining means can be unblocked, the retaining means with the shorter sliding displacement is first unblocked or released or at least loosened. This requires less force than unblocking all the retaining means simultaneously. In a second step, the retaining means with the longer sliding displacement is then unblocked, whereby again less force is required than for unblocking all retaining means simultaneously.

Preferably, for at least one locking means, an upper stop forms an upper limit of the sliding displacement and a lower stop forms a lower limit of the sliding displacement. The stops can be or are firmly connected to the traveling body. The stop may comprise, for example, a stop screw and a locking nut or it may be formed by other means, such as an upper and lower end of an oblong hole.

The stops are used, on the one hand, to limit the sliding displacement and, on the other hand, as a means for transmitting force to the retaining means. When the end of the sliding displacement is reached after the traveling body has started up, the stop hits against the retaining means that is still clamped and ideally transmits a force sufficient to unblock the retaining means.

Since the force required to release only some of the retaining means is considerably less than that required to unlock all the retaining means at the same time, the force when the traveling body starts up can be sufficient to also release a retaining means which is firmly connected to the traveling body and which has no sliding displacement relative to the traveling body. A retaining means which is displaceably arranged on the traveling body has a longer sliding displacement than a firmly mounted retaining means the displacement of which has a length of 0 mm.

However, at least two retaining means are preferably connected to the traveling body in such a way that they are displaceable relative to the traveling body within a sliding displacement respectively limited by an upper stop and a lower stop and that the respective sliding displacements for the at least two retaining means are different in length.

To unblock the retaining means, kinetic energy can be provided in each case, which is generated by the movement of the traveling body along the sliding displacement paths. First, the retaining means with the shorter sliding displacement is unblocked and subsequently the retaining means with the longer sliding displacement is unblocked.

Unblocking does not have to be a complete unblocking. Depending on the type of construction of the retaining means, unlocking is also to be understood as loosening a clamping mechanism of the retaining means. Releasing usually causes a force peak and this force peak, or the corresponding release energy, is transferred by the impact of the load on the stop onto the retaining means.

There may also be provided more than two retaining means, each of which has a different sliding displacement. They are unblocked successively when the traveling body starts moving after a catching process. It is also possible to provide groups of retaining means each having the same sliding displacement, for example two retaining means with short sliding displacements and two retaining means with longer sliding displacements.

The retaining means can be arranged on the traveling body in such a way that they act on the same rail. Preferably, the catching device is designed such that the retaining means brake on different rails.

In an advantageous embodiment of the catching device, the first sliding displacement is up to 1.5 times as long as the second sliding displacement. In order to generate sufficient kinetic energy, sliding displacements of between 5 and 30 mm are usually sufficient.

Preferably, the length of the sliding displacements is adjustable. This means that, for example, the same components can be used for all retaining means and the sliding displacement can then be adjusted individually, preferably in a manufacturing plant.

The catching device may have catching brackets on which the stops are mounted. The stops can be detachably fastened to the catching bracket so that the distance and thus the respective sliding displacement can be adjusted. The stops, for example, can be screwed to the catching bracket.

A separate catching bracket may be provided for each retaining means. However, it is also possible that a plurality of retaining means is arranged on a catching bracket. In the mounted state, the retaining means can be arranged next to each other such that they can brake on different rails.

The displaceability of the retaining means in relation to the traveling body can be achieved, for example, by connecting it to the traveling body by means of screws or bolts in oblong guide holes or by means of a dovetail slide guide or prism slide guide, by means of parallel guide link levers, by means of parallel guide leaf springs or also by means of pivotal mounting. In the case of a pivotal mounting, the retaining means can be attached, for example, by means of a horizontal bolt or elastic mounting in such a manner that a clamping area of the retaining means can pivot vertically over the sliding displacement path.

In an advantageous further development of the invention, the catching device may comprise electromechanical retraining means which, in particular in the deactivated state, release the retaining means for braking.

In particular, the catching device comprises electromechanical retaining means as disclosed in EP 2 785 626 B1. Only in the currentless, i.e. deactivated, state are the retaining means ready to mechanically brake the traveling body with respect to a rail.

When unblocking the retaining means, the retaining means can be brought back into a position in which they can be activated, so that they allow the traveling body to travel without resistance when current is applied.

In one embodiment, only one retaining means is connected to a trigger or a sensor that triggers the blocking. The trigger can be a conventionally known mechanical speed limiter or it can also be an electronic speed limiter. The retaining means are then connected to each other by a coupling mechanism so that the retaining means block together.

In an alternative preferred embodiment of the catching device, the retaining means can be activated separately. This embodiment is particularly suitable for catching devices with electromechanical retaining means, each of which has its own electrical activations. Preferably, the catching device thus comprises electromechanical retaining means.

Preferably, the catching device also includes electromagnetic holding devices which interact with the electromechanical retaining means in such a manner that the retaining means are kept open by the electromagnetic holding devices in the energized state and are released for braking when power is switched off. The electromagnetic holding devices are preferably controlled by an electronic speed limiter. The function of the electronic speed limiter can of course also be integrated into an elevator controller or a corresponding safety box of the elevator system.

In an advantageous embodiment of the catching device, a spring element is arranged on the retaining means; for example, the at least one movable retaining means is in contact with a stop through the spring element which forms the upper limit of the sliding displacement, or in contact with a stop which forms the lower limit of the sliding displacement. The spring element holds and positions the retaining means in a desired position during normal operation of the elevator system.

The spring element can press the retaining means against the lower stop. Alternatively, a spring element can be arranged such that the retaining means is pressed against the upper stop.

Preferably, all retaining means of the catching device, or at least all retaining means which are connected to the load suspension device via a sliding displacement path, are equipped with a spring element.

In normal operation, the retaining means is kept in contact with the stop which forms the upper limit of the sliding displacement and is connected directly or indirectly to the traveling body, wherein this spring element has to compensate at least the weight force of the retaining means.

With this measure it is avoided that during a catching process in a downward movement the traveling body falls onto the retaining means that is clamped to the fixed rail. When the catching device is unblocked by lifting the traveling body with the drive unit of the elevator system, the traveling body is displaced upwards with respect to the retaining means fixed in place on the stationary rail and against the spring force until a stop forming the lower limit of the sliding displacement hits against the retaining means and thus helps to unblock clamping mechanism thereof.

For elevator systems with counterweights, in which a catching device must also secure the traveling body against overspeed in the upward direction, it is advantageous to use a retaining device which is effective as one unit in both directions of movement of the traveling body. In normal operation, the spring element preferably continues to press the retaining means against the upper stop. This means that the retaining means are already in the stop position when initiating a catching process during a downward travel, whereas in case of a catching process during an upward travel the load means still moves within the sliding displacement path when initiating the catching process. This solution is advantageous because higher braking forces are required for a catching process during a downward travel compared to an upward travel, and because therefore both retaining means can clamp the rail at the same time in the case of a catching process during a downward travel and can transmit a corresponding braking force to the load means via the upper stop. As a consequence of this design, both retaining means are actuated during a catching process in the opposite direction, i.e. during an upward travel, but a transfer of the braking force to the load means is then delayed, because one of the retaining means has to cover a greater sliding displacement.

This is another advantage of the separately controllable retaining means. Preferably, the respective separate electrical activations or actuations control the associated retaining means with a slight time difference during the catching process in upward travel. The time difference corresponds to the time required to travel a distance corresponding to the difference between the two sliding displacement distances. After such an adjustment, both retaining means reach the lower stop at the same time, which means that the force transmission into the load suspension means ultimately takes place synchronously or simultaneously.

The arrangements can of course also be exchanged. In normal operation, the spring element or, if necessary, a force of gravity can press the retaining means against the lower stop and the electrical activations or actuations then activate the associated retaining means during a catching process in downward travel in such a manner that the retaining means with the shorter sliding displacement path is activated with the corresponding time difference.

In an advantageous embodiment, the catching device thus comprises retaining means which brake in both directions of movement. After a catching process in downward travel, the retaining means is brought into the unblocked state when the lower stop hits against the retaining means. The retaining device is brought into the unblocked state after a catching process in the upward direction when the upper stop hits against the retaining means.

Preferably, all retaining means act in both directions, wherein different braking forces can be generated for downward and upward directions.

For elevator systems without a counterweight, catching devices with retaining devices that only work in the downward direction of the traveling body are sufficient.

The object is also achieved by an elevator system with a catching device as described above.

An elevator system typically comprises a traveling body, in particular an elevator car, and a rail. Preferably, the elevator system also comprises a second traveling body, in particular a counterweight, which is connected to the first traveling body through a supporting means. The elevator system may have a speed limiter device, for example with a speed limiter rope, by means of which a catching process can be triggered.

In an advantageous embodiment of the elevator system, retaining means with different sliding displacement paths are mounted in such a manner that they act on different rails. In particular, they are arranged on both sides of a traveling body.

The object is further achieved by a method for unblocking a catching device, in particular as described above, for a traveling body of an elevator system, the catching device comprising at least two retaining means which can be brought from a blocked to an unblocked state. The traveling body is set in motion against its direction of movement before the catching process and at least one retaining means is brought into an unblocked state later than at least one further retaining means. Therefore, a lower force must be applied to release the respective retaining means than is necessary to release all retaining means simultaneously.

In a preferred embodiment of the method, the traveling body and at least one retaining means can be moved relative to each other over a sliding displacement. The sliding displacement with respect to at least one retaining means is longer than a further sliding displacement with respect to at least one further retaining means. Therefore, first the at least one retaining means which has the shortest sliding displacement or which is firmly mounted on the traveling body is unblocked or at least loosened, and then the retaining means with the longer sliding displacement.

The kinetic energy generated by the movement over the sliding displacement can be used to mechanically unblock the retaining means.

When the retaining means with the shorter sliding displacement is unblocked, the traveling body has usually already covered part of the available longer sliding displacement compared to the retaining means with the longer sliding displacement. In one embodiment, the traveling body is then continuously moved further and after passing through the remaining sliding displacement of the longer sliding displacement, the traveling body collides with the retaining means with the longer sliding displacement. Since the retaining means with the shorter sliding displacement is already unblocked or at least loosened at this point, the entire remaining drive energy and kinetic energy is available for the retaining means with the longer sliding displacement.

In an alternative embodiment of the method, after releasing a first retaining means, the traveling body is again briefly moved in the direction of movement before the catching process, before the traveling body is again set in motion against its direction of movement before the catching process and at least one further retaining means is brought into an unblocked state.

In this way, the entire sliding displacement of each slidable retaining element can be used to generate kinetic energy. This is particularly advantageous if retaining means with an electromagnetic holding device are used. The activated electromagnetic holding devices then hold the first retaining means in the unblocked position. This prevents this first retaining means from clamping again and the entire drive and kinetic energy is then available to unblock the other retaining means.

Advantageously, the retaining means are monitored by means of position sensors or corresponding switches so that the elevator system is not released for normal operation until all retaining means have been unblocked and reset.

The de-energized state of a catching device with electromechanical retaining means can be caused by a critical event in which a catching process is required and braking takes place by clamping or pressing-on by the retaining means. The de-energized state can also be caused by a non-critical event, for example, if the elevator system is intentionally switched off or a test is carried out.

The electromechanical retaining means can be configured in such a manner that readiness for braking can only be restored when the retaining means is clamped and returned to its initial position by a movement relative to the rail. If the de-energized state occurs as a result of an uncritical event, clamping may not occur at all and, during start-up, the retaining means is not brought into the ready position, i.e. the position it occupies during regular travel of the traveling body.

Before releasing the retaining means, the traveling body can then be moved in the direction of a movement direction before the catching process in order to tension the retaining means. Subsequently, the traveling body is set in motion against the direction of movement before the catching process. After having passed through the sliding displacement path, the retaining device can hit against a stop, thereby unblocking the retaining means. The traveling body is kept moving against the direction of movement before the catching process, whereby the further retaining means, after having passed through the further sliding displacement path, hits against a further stop, whereby the further retaining means is also brought into its unblocked state.

In an advantageous further development of the method according to the invention, the retaining means are of electromechanical design. The unblocking comprises in particular the following steps. First, the holding devices, in particular electromagnetic holding devices, are activated in order to prepare them for holding the retaining means in a ready position. For this purpose, for example, a magnet is energized, which is then able to hold a counterpart attached on the retaining means.

The traveling body is moved in a first direction of travel, preferably in the direction of movement existing before the catching process, in order to tension or re-tension the retaining means. In doing so, the retaining means is either brought into a blocked position or the blocked position is reinforced after a catching process. The retaining means is now in a defined blocking position.

If no catching process has taken place at all, if, for example, the electromechanical catching device has been deactivated due to a non-critical event, such as a power interruption, the movement in the first direction of travel ensures that the catching device takes a position corresponding to that which it would take after a catching process in the direction of the first direction of travel. The first direction of travel thus corresponds to the direction of movement before the catching process.

The traveling body is then moved in a direction opposite to the first direction of travel in order to bring the retaining means into a ready position in which they are held by the activated holding device.

If the traveling body is moved in a direction opposite to the first direction of travel, the retaining means are successively released from the rail and are brought back into an unblocked position.

Therefore, before regular travel operation is resumed after deactivating the electromechanical retaining means, the driving body is first moved in a direction in which the retaining means is either brought into the blocked position or the blocked position is reinforced. This creates a defined initial state for unblocking the retaining means, which is independent of whether a critical or non-critical event has led to the de-energized state. From this state, the catching can be unblocked according to the method described above, in which the retaining means are unblocked one after the other.

In a further advantageous configuration of the method, the traveling body is the elevator car and is connected via a suspension rope to another traveling body in the form of a balancing weight or a counterweight and both are driven together by means of a drive unit. After a catching process in a downward travel of the elevator car, the counterweight is first lifted and then moved downwards. In particular, this is a method as disclosed in EP 2 352 689 B1.

When unblocking the retaining means with the sliding displacement, the kinetic energy of the traveling body generated through the sliding displacement is added to the kinetic energy of the lifted counterweight.

Examples for retaining means are disclosed in EP 1 213 247 A1. Thus, the retaining means can have a base body with a recess for the rail, on one side of which there is a first brake shoe supported by spring elements and on the opposite side of which there is a second brake shoe.

The latter is supported on an eccentric mounted in the base body, which is connected in a rotationally fixed manner to a rolling disc, which has a flat point on its circumference. When the catching device is actuated, the rolling disc connected to the eccentric is rotated about its axis by a release mechanism to such an extent that the non-flattened part of its circumference presses against the rail. As a result of the relative movement between the rail and the rolling disc, the latter is rotated further with the eccentric until a rotation stop is reached, so that the eccentric moves the second brake shoe supported thereon against the rail and clamps the latter between the two brake shoes. The retaining means can brake a downward and an upward movement of the traveling body.

Alternatively, the retaining means can have a base body with a recess for the rail, on one side of which there is a brake plate and on the other side there is a clamping ramp extending at an angle with respect to the rail. The retaining means has a trigger mechanism and a clamping body. When the catching device is actuated by a speed limiter system, a trigger mechanism guides the clamping body between the rail and the clamping ramp that moves relative to the latter, so that the clamping body is wedged between them.

The invention is explained in more detail below by means of examples shown in figures.

DETAILED DESCRIPTION

Figure 1:
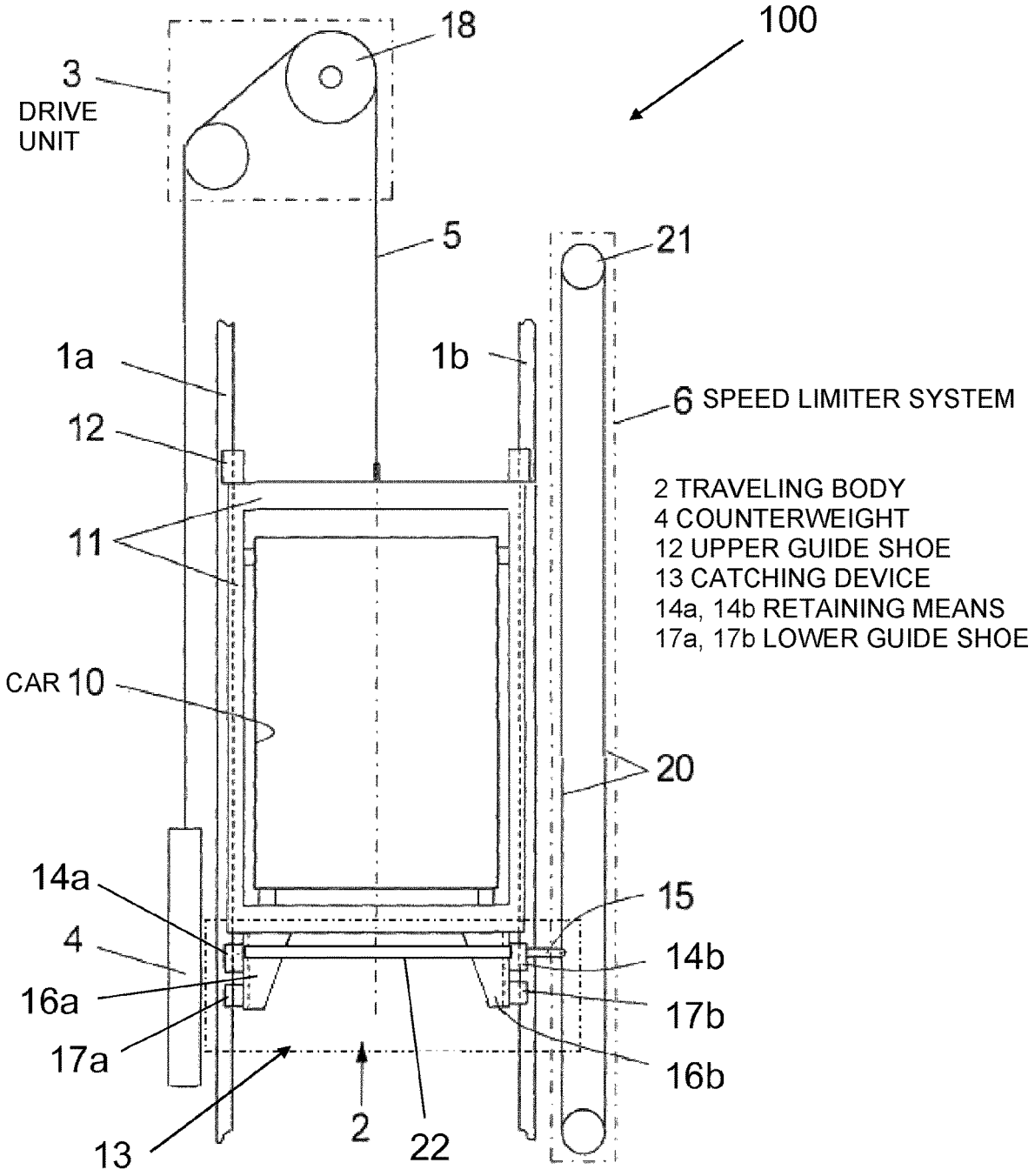
FIG. 1: shows a schematic illustration of a first example of an elevator system with a catching device according to the invention.

FIG. 1 schematically shows a first example of an elevator system 100 equipped with a catching device 13 according to the invention. The elevator system 100 consists substantially of a traveling body 2 guided on rails 1*a*, 1*b*, a drive unit 3, a counterweight 4, a number of suspension ropes 5 and a speed limiter system 6.

The traveling body 2 comprises a car 10, a car frame 11, upper guide shoes 12 and a catching device 13 according to the invention. Such a catching device 13 comprises two retaining means or units 14*a*, 14*b*, each of which is mounted on a catching bracket 16*a*, 16*b* connected to the traveling body 2. The latter additionally carry two lower guide shoes 17*a*, 17*b*.

The travelling body 2 and the counterweight 4 are suspended from the suspension ropes 5 guided by a traction sheave 18 of the drive unit 3 and are moved up and down along rails 1*a*, 1*b* by the drive system formed by these components.

If a speed limit is exceeded, a speed limiter rope 20, which is normally moved synchronously with the traveling body 2, is blocked by a speed limiter 21, whereby the retaining means or units 14*a*, 14*b* of the catching device 13 connected to one another via a coupling mechanism 22 are brought into the braking state via a trigger lever 15, thus are deactivated accordingly.

Clamping mechanisms contained in the retaining means 14*a*, 14*b* thereby generate a clamping action between the first and second retaining means 14*a*, 14*b* and the first and second guide rails 1*a*, 1*b*, respectively, by utilizing the kinetic energy of the traveling body 2.

Figure 2A:
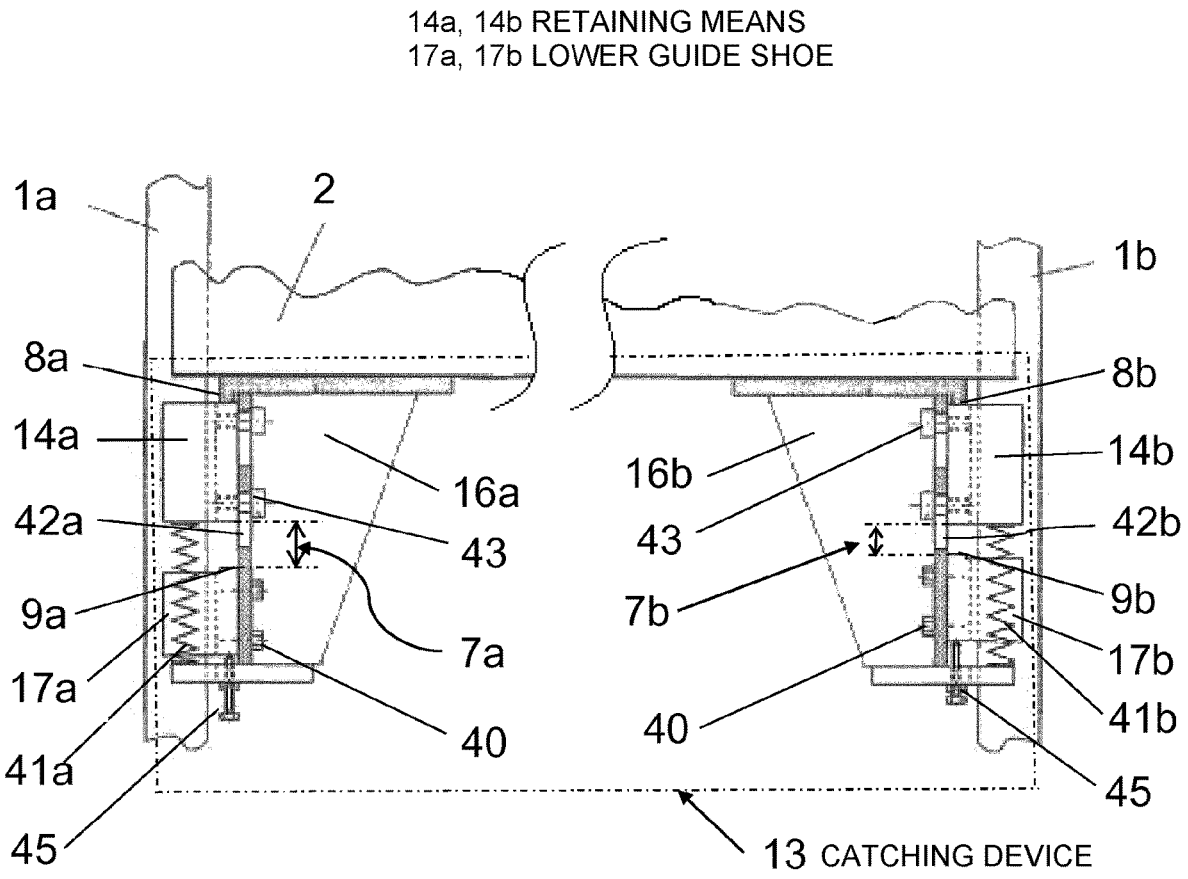
FIG. 2*a*: shows schematically a first example of a catching device according to the invention after a catching process in a downward movement of the traveling body.
Figure 2B:
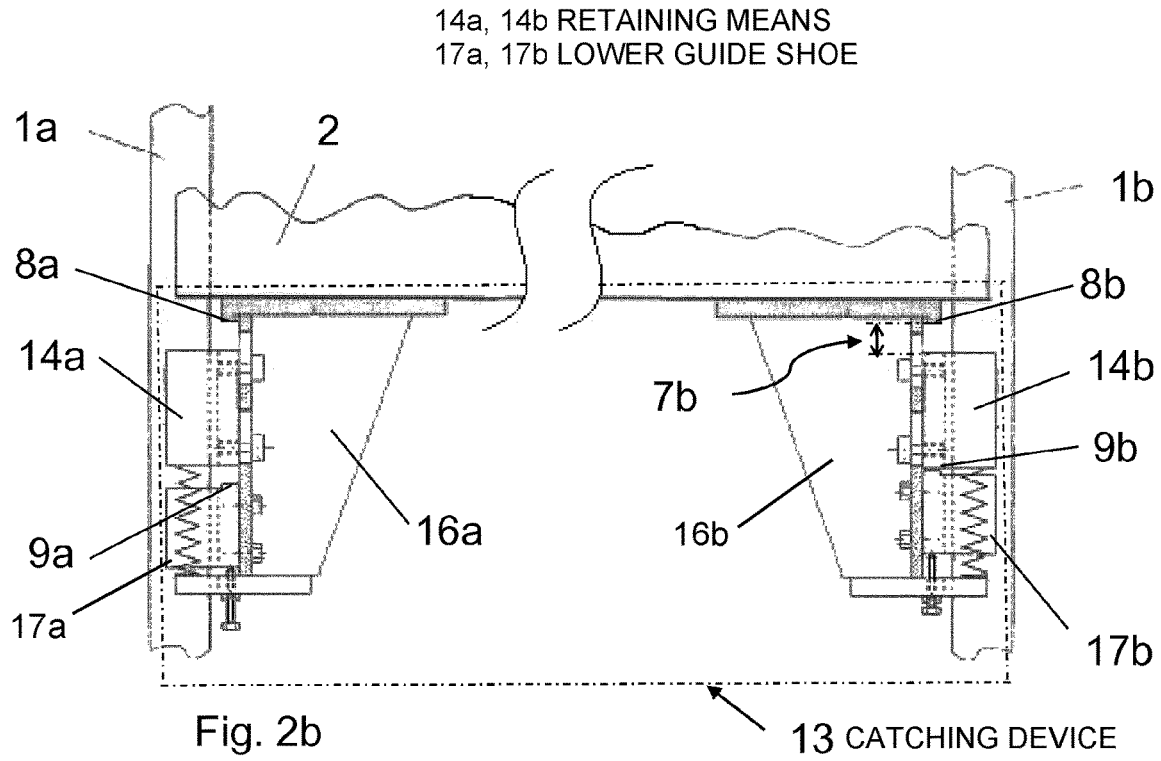
FIG. 2*b*: shows schematically the catching device of FIG. 2*a* in a first moment of the unblocking process.
Figure 2C:
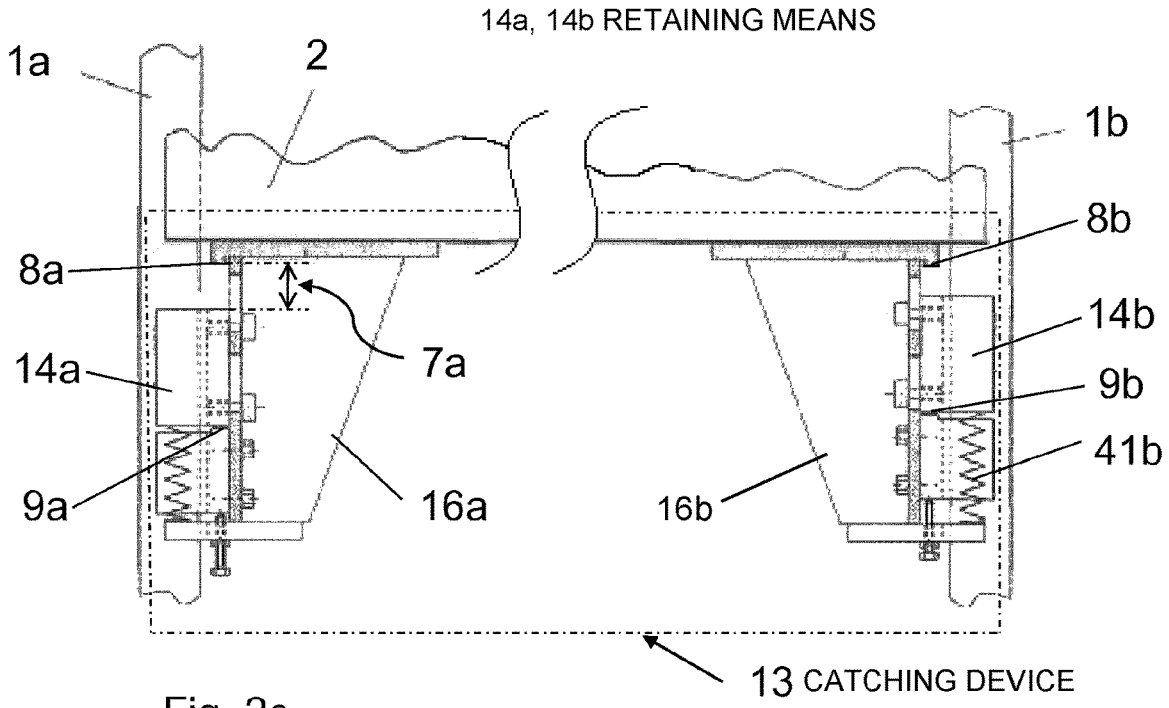
FIG. 2*c*: shows schematically the catching device of FIGS. 2*a* and 2*b* in a second moment of the unblocking process.

FIGS. 2*a* to 2*c* illustrate the mode of operation of the catching device 13 according to the invention attached to a traveling body 2. The guide rails 1*a*, 1*b*, the retaining means 14*a*, 14*b*, the catching brackets 16*a*, 16*b*, lower guide shoes 17*a*, 17*b* and spring elements 41*a*, 41 *b* can be seen.

The retaining means 14*a*, 14*b* are each attached to the catching brackets 16*a*, 16*b* by means of collar screws 43 guided in oblong holes 42*a*, 42*b* so as to be vertically displaceable.

An upper stop 8*a* integrated in the catching bracket 16*a* and a lower stop 9*a*, which is designed as or integrated in a guide shoe 17*a*, delimit a sliding displacement 7*a* of the first retaining means 14*a*.

An upper stop 8*b* integrated in the catching bracket 16*b* and a lower stop 9*b*, which is designed as or integrated in the guide shoe 17*b*, delimit the sliding displacement path 7*b* of the second retaining means 14*b*.

The sliding displacement 7*a* of the first retaining means 14*a* is longer than the sliding displacement 7*b* of the second retaining means 14*b*.

Screws 40 which can be loosened and positioning screws 45 allow to adjust optimum sliding displacements 7*a*, 7*b*. In normal operation, the spring elements 41*a*, 41*b* keep the retaining means 14*a*, 14*b* in contact with the respective upper stop 8*a*, 8*b* against their respective weight force.

FIG. 2*a* illustrates the position of the retaining means 14*a*, 14*b* after a catching process in a downward movement of the traveling body 2, which also corresponds to the position in normal operation.

The self-locking clamping mechanisms of the retaining means 14*a*, 14*b*, which are stuck on the guide rails 1*a*, 1*b*, are unblocked by moving the traveling body 2 upwards by means of the drive unit 3 of the elevator system 100 and with the greatest possible acceleration (see FIG. 1). In order to achieve the greatest possible acceleration, the counterweight 4 can first be lifted slightly so that the kinetic energy of the falling or backwards moving counterweight contributes to the acceleration. Lifting can be carried out as described in EP 2 352 689 B1.

FIG. 2*b* shows the arrangement of the catching device 13 after a travel path of the traveling body 2, which corresponds to the shorter sliding displacement 7*b*.

The lower guide shoe 17*b*, which serves as the lower stop 9*b*, moves together with the traveling body 2 and hits against the retaining means 14*b*, which is still firmly clamped. Using the kinetic energy of the entire traveling body 2, the clamping mechanism is unlocked or released from the clamping end point. The lower stop 9*a* of the other catching bracket 16*a* has not yet reached the retaining means 14*a*.

Continuing the movement process of the traveling body 2, after the retaining means 14*b* has been at least partially unblocked or released, the traveling body 2 continues to move.

FIG. 2*c* shows the arrangement of the catching device 13 after a travel that corresponds to the longer sliding displacement 7*a*. The retaining means 14*b* with the shorter sliding displacement is already unblocked. Since the complete resetting of the retaining device after its release from the clamping end point requires a greater distance, the retaining means 14*b* still rests against the lower stop 9*b*. Only after being completely released, it will be pressed against the upper stop 8*b* by the spring element 41*b*.

After covering the longer sliding displacement distance 7*a*, the lower stop 9*a* also hits against the still firmly clamped retaining means 14*a* and unblocks it.

Thereafter, the retaining means 14*b* that has been released first then returns to its normal position with respect to the catching bracket 16*b* and subsequently the next retaining means 14*a* also returns to its normal position with respect to the catching bracket 16*a* and the catching device 13 is again in the arrangement shown in FIG. 2*a*.

The unblocking effect of the catching device 13 according to the invention is also given in the case of catching processes in an upward movement of the traveling body 2. Either double-acting retaining means 14*a*, 14*b*, which are not shown in detail, or two single-acting retaining means 14*a*, 14*b* which are each associated with one direction of movement and are also not shown in detail, are used.

After the catching device 13 has been triggered as a result of overspeed of the traveling body 2 in the upward direction, the retaining means 14*a*, 14*b* are clamped to the guide rails 1*a*, 1*b* in a frictionally engaged manner and thereby move relative to the catching brackets 16*a*, 16*b* against the force of the spring elements 41*a*, 41*b* up to the stop at the lower guide shoes 17*a*, 17*b*.

The retaining means 14*a*, 14*b* usually remains in this position even after the traveling body 2 has come to a standstill. In order to unblock the clamping mechanisms of the retaining means 14*a*, 14*b*, which are fixed to the guide rails 1*a*, 1*b*, the traveling body 2 with the catching brackets 16*a*, 16*b* is lowered with the greatest possible acceleration, which is usually done with the aid of the drive unit 3. After a lowering movement of the traveling body 2 corresponding to the shorter limited sliding displacement 7*b*, the upper stop 8*b* hits against the corresponding retaining means 14*b* and unblocks it. When, after a further lowering movement, the longer sliding displacement 7*a* has also been covered, the other upper stop 8*a* also hits against the corresponding retaining means 14*a*, thereby unblocking this one as well.

Figure 3:
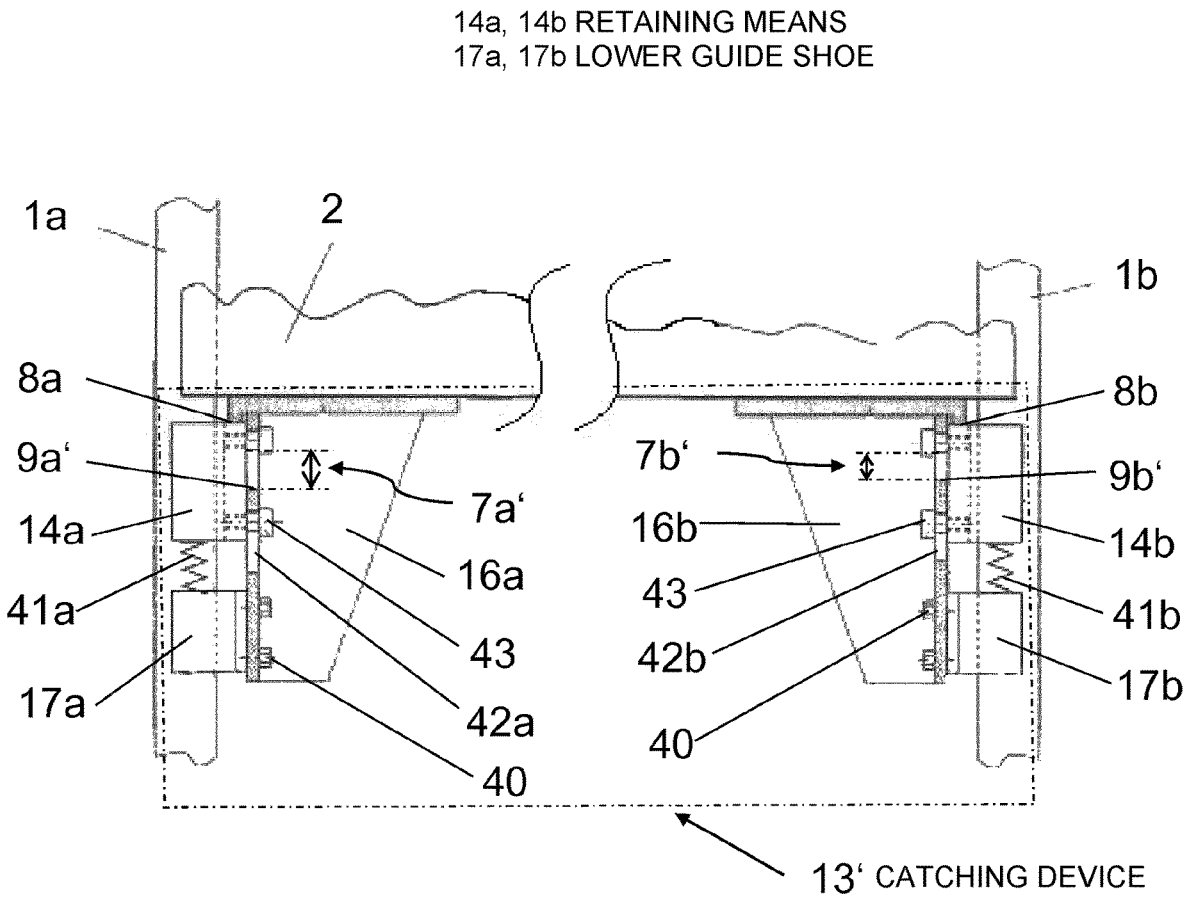
FIG. 3: schematically shows a second example for a catching device according to the invention after a catching process in a downward movement of the traveling body.

FIG. 3 schematically shows a second example of a catching device 13' according to the invention after a catching process in a downward movement of the traveling body 2. The position shown in FIG. 3 also corresponds to the position in normal operation.

The catching device corresponds largely to the catching device 13 shown in FIGS. 2*a* to 2*c*. Here too, the retaining means 14*a*, 14*b* are each attached to the catching brackets 16*a*, 16*b* by means of two collar bolts 43 guided in oblong holes 42*a*, 42*b* to be vertically displaceable. The upper stops 8*a*, 8*b* are still integrated in the catching brackets 16*a*, 16*b*.

However, the lower stops 9*a*', 9*b*' are not fixed to the guide shoes 17*a*, 17*b*. The lower stops 9*a*', 9*b*' and thus the lower limits of the sliding displacements 7*a*', 7*b*' are given by the oblong holes 42*a*, 42*b*. Thus, the lower stops 9*a*', 9*b*' are not adjustable. In an adapted embodiment, the upper stops can also be given by the upper ends of the oblong holes 42*a*, 42*b*.

Figure 4:
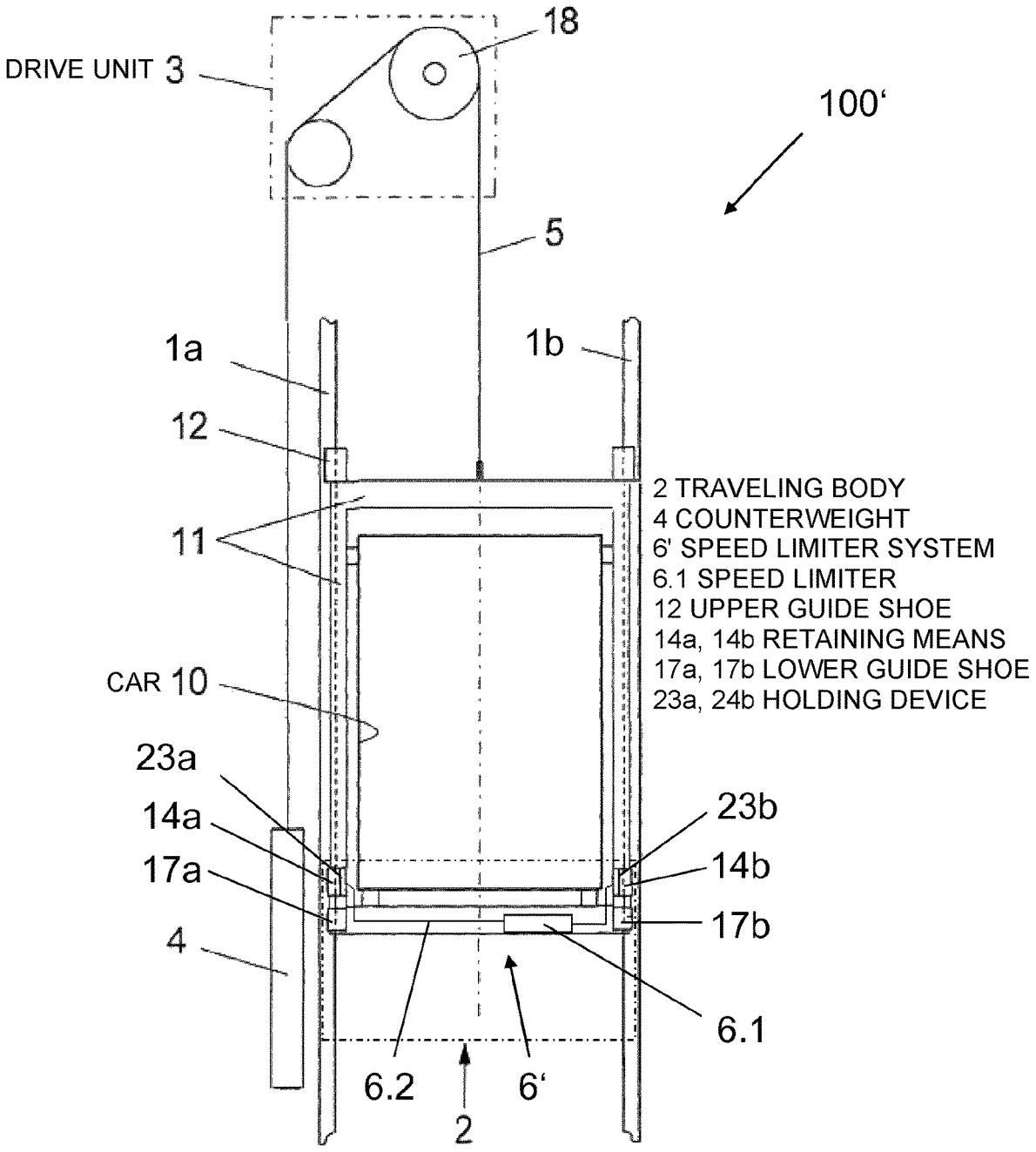
FIG. 4: shows a schematic illustration of a second example for an elevator system with a catching device according to the invention.

FIG. 4 schematically shows another example of an elevator system 100'. The latter corresponds in large parts to the elevator system 100 in FIG. 1 and also comprises a traveling body 2 guided on rails 1*a*, 1*b*, a drive unit 3, a counterweight 4, a number of suspension ropes 5 and a speed limiter system 6'.

However, in this example, the speed limiter system 6' comprises an electronic speed limiter 6.1, which activates electromagnetic holding devices 23*a*, 23*b* of the retaining means 14*a*, 14*b* by means of signal lines 6.2. The retaining means 14*a*, 14*b* are kept open by the electromagnetic retaining devices 23*a*, 23*b* in the energized state and are released for braking when the power is turned off.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A catching device for a traveling body comprising:

first and second retaining means, the first retaining means actuatable between a blocked state and an unblocked state and being adapted, in the blocked state, to clamp and retain the traveling body on a first rail;

the second retaining means actuatable between a blocked state and an unblocked state and being adapted, in the blocked state, to clamp and retain the traveling body on a second rail;

where the first retaining means and the traveling body are slidable relative to one another within a limited first sliding displacement in a direction of movement of the traveling body along the first rail when the first retaining means is mounted on the traveling body, and where the second retaining means and the traveling body are slidable relative to one another within a limited second sliding displacement in a direction of movement of the traveling body along the second rail when the second retaining means is mounted on the traveling body, and the limited first sliding displacement is longer than the limited second sliding displacement by an incremental distance, wherein, to actuate the first and second retaining means from the blocked state to the unblocked state, the traveling body is set in motion relative to the first and second retaining means, and when the traveling body traverses the limited second sliding displacement the second retaining means is released from the second rail into the unblocked state, and when the traveling body further traverses the incremental distance the first retaining means is released from the first rail into the unblocked state.

2. The catching device according to claim 1 including at least one of for the first retaining means an upper stop forming an upper limit of the first sliding displacement and a lower stop forming a lower limit of the first sliding displacement and for the second retaining means an upper stop forming an upper limit of the second sliding displacement and a lower stop forming a lower limit of the second sliding displacement, and wherein the upper and lower stops are firmly connected to the traveling body.

3. The catching device according to claim 1 wherein the first and second retaining means are connected to the traveling body for sliding relative to the traveling body within the first and second sliding displacements respectively that are each delimited by an upper stop and a lower stop.

4. The catching device according to claim 1 wherein the first sliding displacement is up to 1.5 times as long as the second sliding displacement.

5. The catching device according to claim 1 wherein the first and second retaining means are electromechanical retaining means that, in a deactivated state, release the first and second retaining means for braking into the blocked state.

6. The catching device according to claim 5 including electromagnetic holding devices that interact with the electromechanical retaining means to keep the electromagnetic holding devices open in an energized state of the electromagnetic holding devices and wherein the electromechanical retaining means are released for braking into the blocked state when electrical power to the electromagnetic holding devices is turned off.

7. The catching device according to claim 1 including a spring element arranged on each of the first and second retaining means and pressing the first and second retaining means against an upper stop that delimits the limited sliding displacement.

8. The catching device according to claim 1 wherein the first and second retaining means are adapted for braking in two directions of movement of the traveling body.

9. An elevator system comprising:

the catching device mounted on the traveling body according to claim 1;

the first and second rails along which the traveling body moves; and the catching device being adapted to clamp and retain the traveling body on the first and second rails in a blocked state of the catching device.

10. The elevator system according to claim 9 wherein the first and second retaining means are mounted on the traveling body to clamp on the first and second rails respectively and wherein the first and second rails are arranged on opposite sides of the traveling body.

11. A method for unblocking a catching device of an elevator system comprising the steps of:

mounting the catching device on the traveling body according to claim 1; and when the first and second retaining means of the catching device are in the blocked state, moving the traveling body in a second direction opposite a first direction of movement of the traveling body before the first and second retaining means assumed the blocked state to actuate the first retaining means into the unblocked state later than actuating the second retaining means into the unblocked state.

12. The method according to claim 11 including moving the traveling body relative to the first retaining means over the first sliding displacement that is longer than the second sliding displacement.

13. The method according to claim 11 including before moving the traveling body in the second direction moving the traveling body in the first direction to tension the first and second retaining means.

14. The method according to claim 11 wherein the first and second retaining means are electromechanical retaining means and including the steps of:

activating electromagnetic holding means for holding the electromechanical retaining means in a ready position;

moving the traveling body in the first direction of travel to tension or re-tension the electromechanical retaining means; and moving the traveling body in the second direction opposite to the first direction to unblock the electromechanical retaining means and bring the electromechanical retaining means into the ready position to be held by the activated electromagnetic holding devices.

15. The method according to claim 11 wherein the traveling body is connected to a counterweight via a suspension rope driven by a drive unit, and wherein after a downward travel of the traveling body and actuation of the first and second retaining means into the blocked state, lifting the counterweight and then moving the counterweight downward to actuate the first and second retaining means into the unblocked state.

16. An elevator system comprising:

first and second guide rails along which a traveling body moves in a direction of movement;

first and second retaining means, the first retaining means actuatable between a blocked state and an unblocked state and being adapted, in the blocked state, to clamp and retain the traveling body on the first guide rail, the second retaining means actuatable between a blocked state and an unblocked state and being adapted, in the blocked state, to clamp and retain the traveling body on the second guide rail;

first and second upper stops fixedly coupled to the traveling body; and first and second lower stops positioned relative to the traveling body by first and second positioning screws;

where the first retaining means and the traveling body are slidable relative to one another within a limited first sliding displacement in the direction of movement of the traveling body along the first rail when the first retaining means is mounted on the traveling body, wherein the limited first sliding displacement is delimited by the first upper stop and the first lower stop, and where the second retaining means and the traveling body are slidable relative to one another within a limited second sliding displacement in the direction of movement of the traveling body along the second rail when the second retaining means is mounted on the traveling body, wherein the limited second sliding displacement is delimited by the second upper stop and the second lower stop, and the first and second lower stops have different positions in the direction of movement relative to the traveling body such that the limited first sliding displacement is longer than the limited second sliding displacement by an incremental distance, wherein, to actuate the first and second retaining means from the blocked state to the unblocked state, the traveling body is set in motion relative to the first and second retaining means, and when the traveling body traverses the limited second sliding displacement the second lower stop contacts and releases the second retaining means from the second rail into the unblocked state, and when the traveling body further traverses the incremental distance the first lower stop contacts and releases the first retaining means from the first rail into the unblocked state.

* * * * *